US007013604B1

(12) United States Patent
Moody et al.

(10) Patent No.: US 7,013,604 B1
(45) Date of Patent: Mar. 21, 2006

(54) WINDOW OPERATOR

(75) Inventors: Roy Malcolm Moody, Wellington (NZ); Robert Efstratiou, Wellington (NZ); Malcolm David Boosey, Wellington (NZ)

(73) Assignee: Assa Abloy Financial Services AB, Stockholm (SE)

( * ) Notice: Subject to any disclaimer, the term of this patent is extended or adjusted under 35 U.S.C. 154(b) by 13 days.

(21) Appl. No.: 09/610,229

(22) Filed: Jul. 5, 2000

(30) Foreign Application Priority Data

Jul. 5, 1999 (NZ) ..... 336579

(51) Int. Cl.
*E05F 11/12* (2006.01)

(52) U.S. Cl. ..... 49/341

(58) Field of Classification Search ..... 44/280, 44/283–286, 291–296, 299, 300, 341, 345, 44/187, 191

See application file for complete search history.

(56) References Cited

U.S. PATENT DOCUMENTS

| | | | | | |
|---|---|---|---|---|---|
| 1,724,011 | A | | 8/1929 | Flagg | |
| 2,366,613 | A | | 1/1945 | Hagstrom | |
| 2,817,511 | A | | 12/1957 | Reynaud | |
| 3,032,330 | A | | 5/1962 | Stavenau | |
| 3,071,219 | A | * | 1/1963 | Vuncannon | 49/295 |
| 3,911,621 | A | * | 10/1975 | McHeffey | 49/192 |
| 3,934,370 | A | * | 1/1976 | Kwan et al. | 49/341 |
| 4,064,649 | A | * | 12/1977 | Rasmussen et al. | 49/250 |
| 4,074,462 | A | * | 2/1978 | McHeffey | 49/192 |
| 4,307,542 | A | * | 12/1981 | Lense | 49/318 |
| 4,339,892 | A | * | 7/1982 | Ulbricht et al. | 49/192 |
| 4,497,135 | A | * | 2/1985 | Vetter | 49/280 |
| 4,541,200 | A | * | 9/1985 | Gartner | 49/192 |
| 4,553,656 | A | | 11/1985 | Lense | |
| 4,703,960 | A | * | 11/1987 | Lense | 292/69 |
| 6,122,863 | A | * | 9/2000 | Tippin et al. | 49/279 |

FOREIGN PATENT DOCUMENTS

| | | |
|---|---|---|
| EP | 0226785 | 1/1987 |
| FR | 692 652 | 11/1930 |

* cited by examiner

*Primary Examiner*—Daniel P. Stodola
(74) *Attorney, Agent, or Firm*—Blakely Sokoloff Taylor & Zafman

(57) ABSTRACT

A window operator for moving a window sash in a window frame (F) between open and closed positions. The window operator has a mounting plate (14), an elongate threaded member (16) mounted with the mounting plate (14). A drive handle (11) enables a rotational movement to be applied to the elongate threaded member (16). A threaded element (66) is located on the elongate threaded member (16). A hinge (26) with which a window sash can be mounted is attached to a coupling (23) moveable in response to movement of the threaded element (66) on the elongate threaded member (16). The hinge (26) has one arm (28) pivotally coupled to the mounting plate (14). Because arms (24 and 25) of the hinge (26) is attached to the coupling (23), movement of the coupling (23) results in movement of the hinge (26).

16 Claims, 12 Drawing Sheets

WINDOW OPERATOR

BACKGROUND TO THE INVENTION

This invention relates to a window operator.

It is well known to provide a window operator for controlling movement of a window sash relative to a window frame with which the sash is mounted by hinges. The operator enables the sash to be moved between open and closed positions. Typically the window operator is surface mounted to the window frame and a drive arm couples the operator to the window sash. The housing incorporates a winding handle which drives via gears, the drive arm. By being surface mounted to the frame the window operator housing is readily apparent and can spoil the aesthetic appeal of the window frame/surround.

Typically a window sash is mounted within the window frame or surrounded by a pair of hinges which are commonly referred to as window stays. Therefore when mounting the sash within the frame the fabricator not only needs to install a pair of window stays but also needs to mount the window operator to the frame/surround and then mechanically connect the drive arm of the operator to the sash. Therefore mounting of the sash within the frame/surround could be simplified and costs minimised if the window operator could be arranged to play some part in the mounting of the sash with the window frame.

For security reasons it is known to provide a window sash with a multi-point locking arrangement. The multi-point lock is controlled by a handle which is mounted externally on the frame/surround so as to enable the multi-point to be locked and unlocked. Yet again this can have an undesirable impact on the aesthetic appeal of the window frame/surround especially when the window frame/surround also mounts a window operator housing.

SUMMARY OF INVENTION

It is therefore an object of the present invention to provide a window operator whereby the mechanical operating elements to apply a driving force to the sash can be concealed within the window frame/surround.

It is a further object of the present invention to provide a window operator which can achieve the additional function of in part mounting a sash within the window frame/surround.

It is therefore yet a further object of the present invention to provide a window operator and multi-point lock combination whereby operation of the multi-point can be achieved via the window operator.

Broadly in one aspect of the invention there is provided a window operator including a mounting means, an elongate threaded member mounted with the mounting means, drive means to apply a rotational movement to the elongate threaded member, a threaded element located on the elongate threaded member, a hinge means with which a window sash can be mounted and coupling means moveable in response to movement of the threaded element on the elongate threaded member the hinge means being associated with the coupling means such that movement of the coupling means results in movement of the hinge means.

According to another broad aspect of the invention there is provided a window operator including a mounting means and drive transfer means mountable in a cavity formed between a window sash and window frame when the sash is in the closed position such that the mounting means and drive transfer means are not visible, an operator handle and handle mounting means mountable to a surface of the window frame, the operator handle being coupled to the drive transfer means and the drive transfer means being drivingly coupled to an elongate threaded member mounted with the mounting means, a threaded element located on the elongate threaded member being connected to link means engageable with the window sash.

In a third broad aspect of the invention there is provided a window operator according to the first broad aspect further including lost motion means between the threaded element and the coupling means, and engagement means for engaging with a locking means mountable with the window sash, the engagement means being movable by said lost motion means to operate the locking means.

DESCRIPTION OF THE PREFERRED EMBODIMENTS

Figure 1:
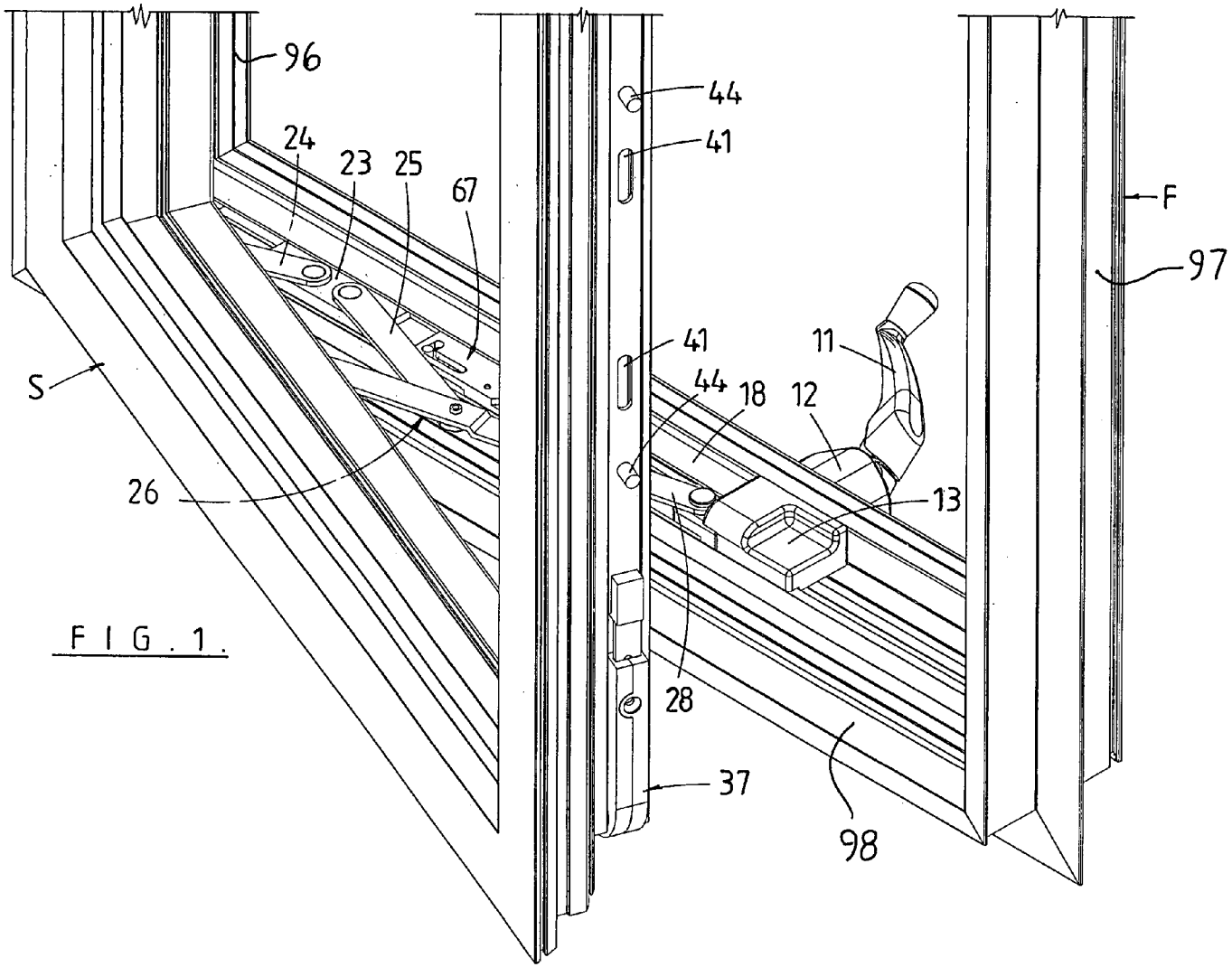
FIG. 1 is a perspective view of a window frame and sash incorporating a window operator of the present invention the sash being in an open position.
Figure 2:
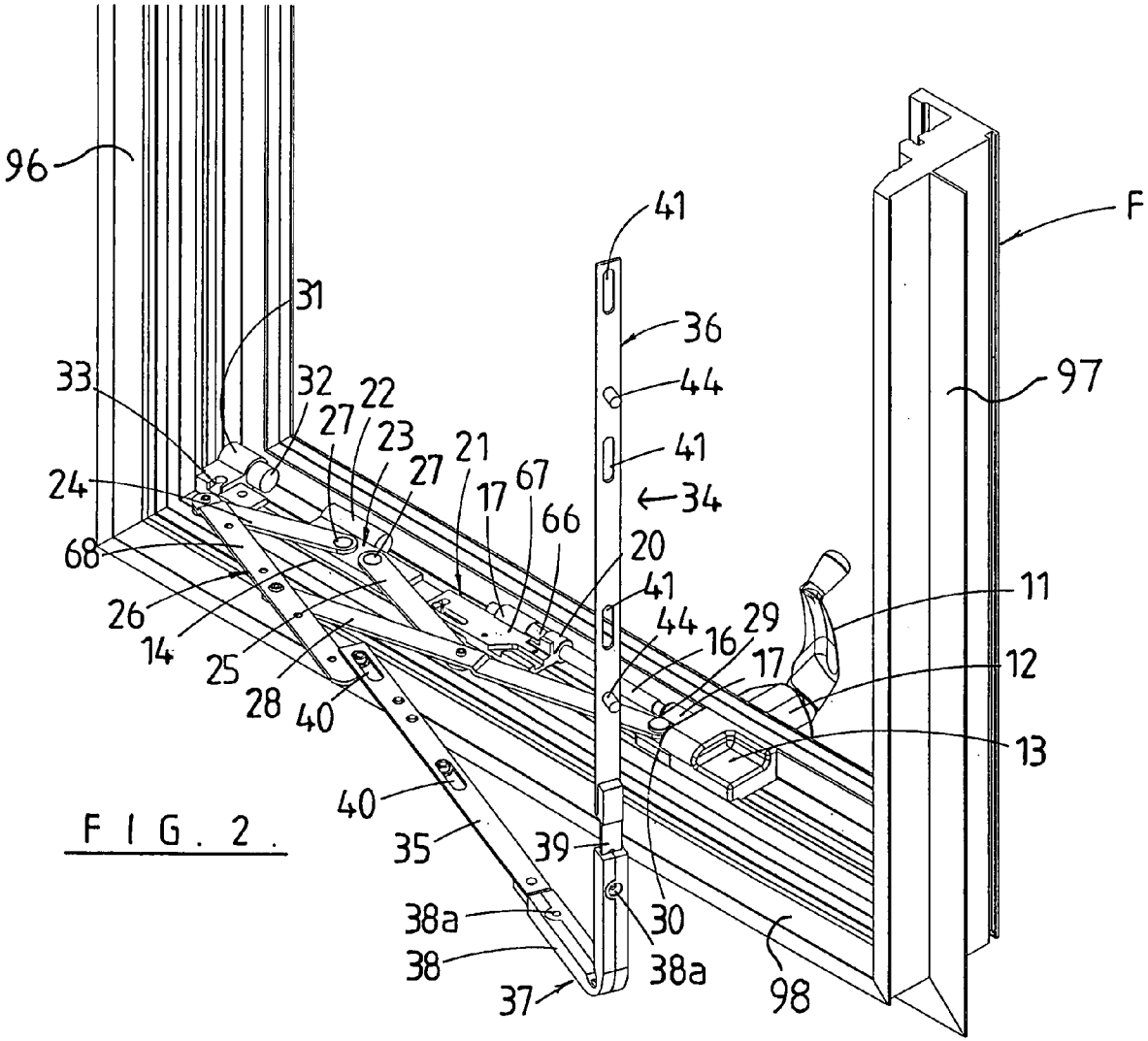
FIG. 2 is a view similar to FIG. 1 but with the window sash removed.
Figure 3:
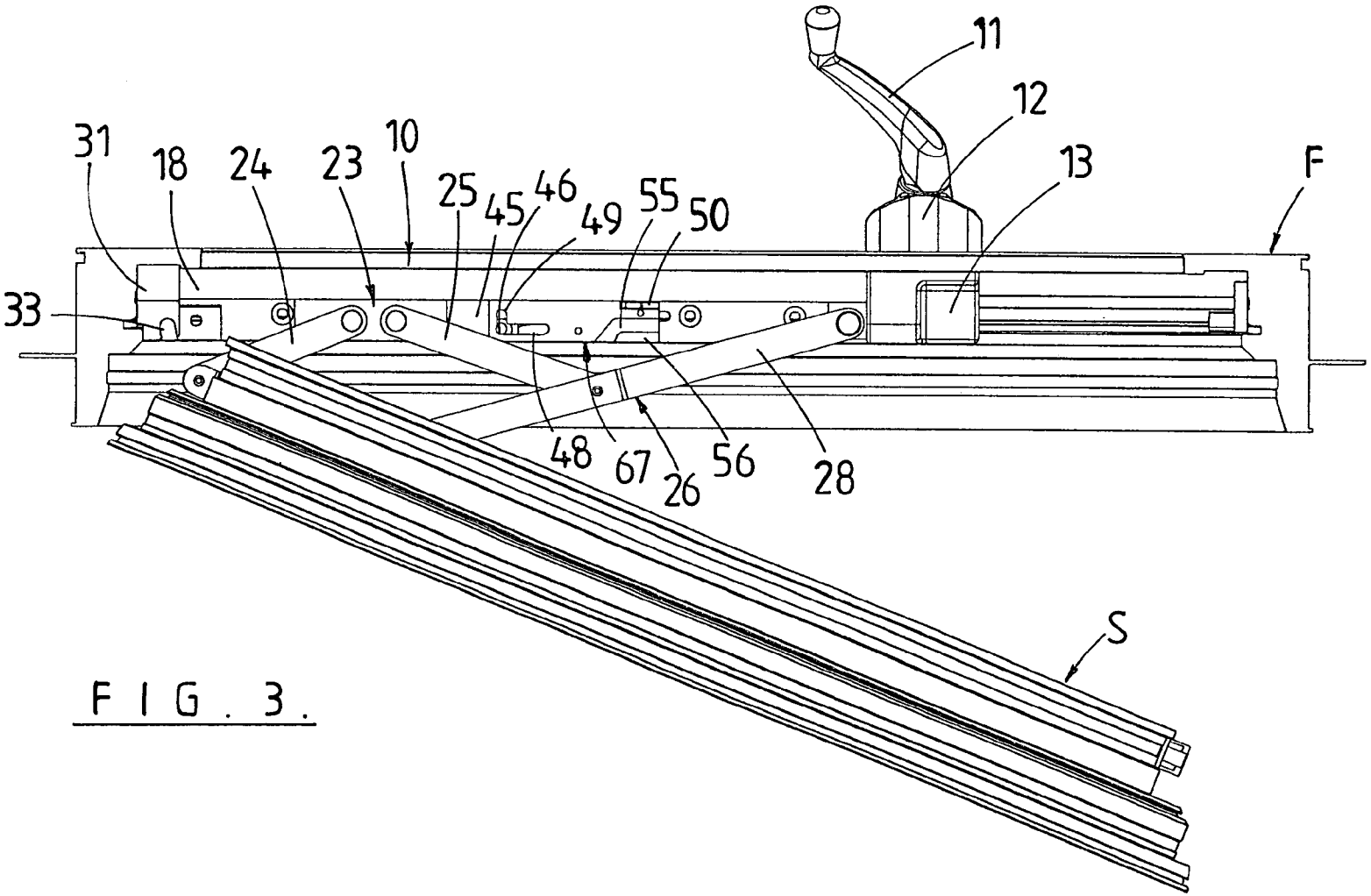
FIG. 3 is a plan view of the arrangement shown in FIG. 1.

As can be seen from the drawings, the majority of the window operator 10 is mounted to the window frame and located within a cavity which is formed between the window frame F and the window sash S when the sash is in the closed position. The window operator handle 11 is mounted with a mounting plate or housing 12 which surface mounts to the surface of the frame F. Frame F includes side jams 96 and 97, sill 98 and a top piece (not shown) that is connected on top of side jams 96 and 97 and opposes sill 98. As with typical window frames, side jams 96 and 97 fit into a window opening and form the sides (left and right) of a window and sill 98 is the bottom portion of a window.

A drive shaft (not shown) extends from the handle 11 through the frame F to engage with bevel gears (not shown) located within a housing 13. The housing 13 is mounted with, or formed as part of, a mounting plate 14, which forms a mounting for the operator 10 to be mounted to the window frame. The mounting plate 14 is provided with suitable openings 15 for attachment by suitable mechanical fasteners to the frame F.

Figure 4:
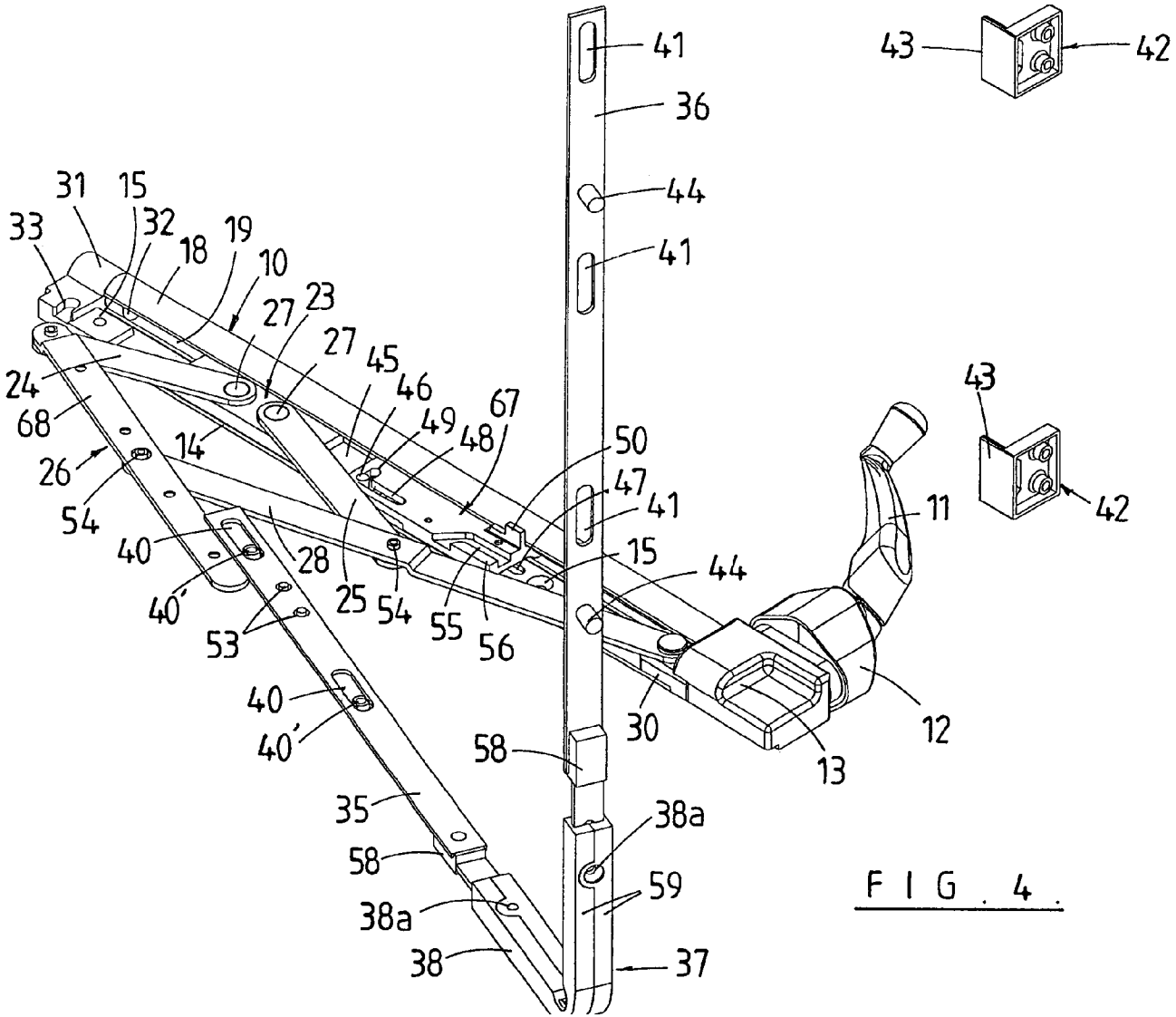
FIG. 4 is a perspective view of the window operator and an associated multi-point lock.

The bevel gears within housing 13 are drivingly coupled to a lead screw 16 which is journalled in suitable bearings 17. The bearings 17 and lead screw 16, are in the preferred form, located within an elongate housing 18 which extends along one side of mounting plate 14. The housing 18 is provided with an elongate longitudinally extending gap 19 (See FIG. 4) which is located adjacent to, but slightly above, the surface of mounting plate 14.

A nut 66 is threaded onto the lead screw 16. Nut 66 is coupled to a coupling device comprising a driver 67, follower 21 and mounting plate 23. Accordingly, as handle 11 is rotated, a drive via the drive shaft and bevel gears is imparted to the lead screw 16. Depending on the rotation of the handle 11, the nut 66 moves along the lead screw 16 either toward the housing 13 (window opening) or toward the distal end of the lead screw 16 (window closing).

The driver 67 has a sleeve 20 which is journalled onto lead screw 16. The driver 67 is also coupled in a manner which will hereinafter be described to a follower 21. The follower 21 has a sliding element 22 which slides within elongate housing 18. Furthermore the follower 21 has a mounting plate 23 to which arms 24 and 25 of a window stay 26 are mounted by pivot bearings 27.

The window stay 26 is of a largely conventional construction whereby arm 24 is pivotally coupled at one end to a sash mounting plate 68 while arm 25 is pivotally coupled in the length of a long arm 28. This long arm 28 is also pivotally coupled at one end to the sash plate 68. The other end of the long arm 28 is pivotally mounted by bearing 29 to a mounting flange or base 30.

The elongate mounting plate 14 has, at the end opposite to housing 13, an end stop 31. End stop 31 includes a plug 32 for engagement with elongate housing 18. The end stop 31 also includes, in a conventional manner, a head lock 33 for engagement with the pivot coupled arm 24 and sash plate 27.

Thus according to the pre sent invention the window stay 26 forms part of the window operator 10. The window stay 26 thus in part hingedly mounts the sash S within the window frame F. It also imparts opening and closing movement to the sash S as a consequence of movement of follower 21 which is caused to move due to its coupling via driver 67 to nut 66. Thus as nut 18 moves along lead screw 16 in response to a winding action being applied to handle 11 the stay 26 moves the sash.

The operator mechanism is concealed within the frame F with the only externally visible elements (when the sash is in the closed position) being the handle 11 and the mounting plate or sub-housing 12.

In a preferred form of the invention a lost motion mechanism couples the driver 67 to the follower 21. This lost motion mechanism enables the operator 10 to also operate a multi-point lock mechanism 34.

The multi-point mechanism 34 includes in a conventional manner a first lock plate 35 which, in the casement installation of a sash S in a frame F as illustrated, locates with the bottom edge surface of the sash S. A second lock plate 36 engages with the vertical edge surface of the sash S which is opposite to the hinge side of the sash.

The lock plates 35 and 36 are coupled by a corner drive 37 which essentially consists of a housing 38 within which a connector means 39 in the form of a strap is slidingly engaged. One end of the strap 39 is coupled to lock plate 35 while the other end is coupled to lock plate 36. The housing has openings 38*a* which enables the housing to be fastened by, e.g., screws to the corner of the sash.

In a conventional manner, a pair of elongate slots 40 are formed in lock plate 35. Engaged through slots 40 are headed pins, spigots or the like 40' which engage or are fastened to the sash S. More or less slots 40 and spigots 40' may be employed as necessary. This is a known arrangement which enables the lock plate 35 to be longitudinally slidable. In a like manner, elongate slots 41 are provided in the second lock plate 36 so that it also is slidingly mountable with the sash S.

A pair of keepers 42 are mountable with the frame F. The keepers 42 each incorporate a flange 43. The lock plate 36 includes a pair of lock pins 44 which upon the lock plate 36 being moved to a locking position, when the window sash S is closed, engage behind the flanges 43.

Figure 5:
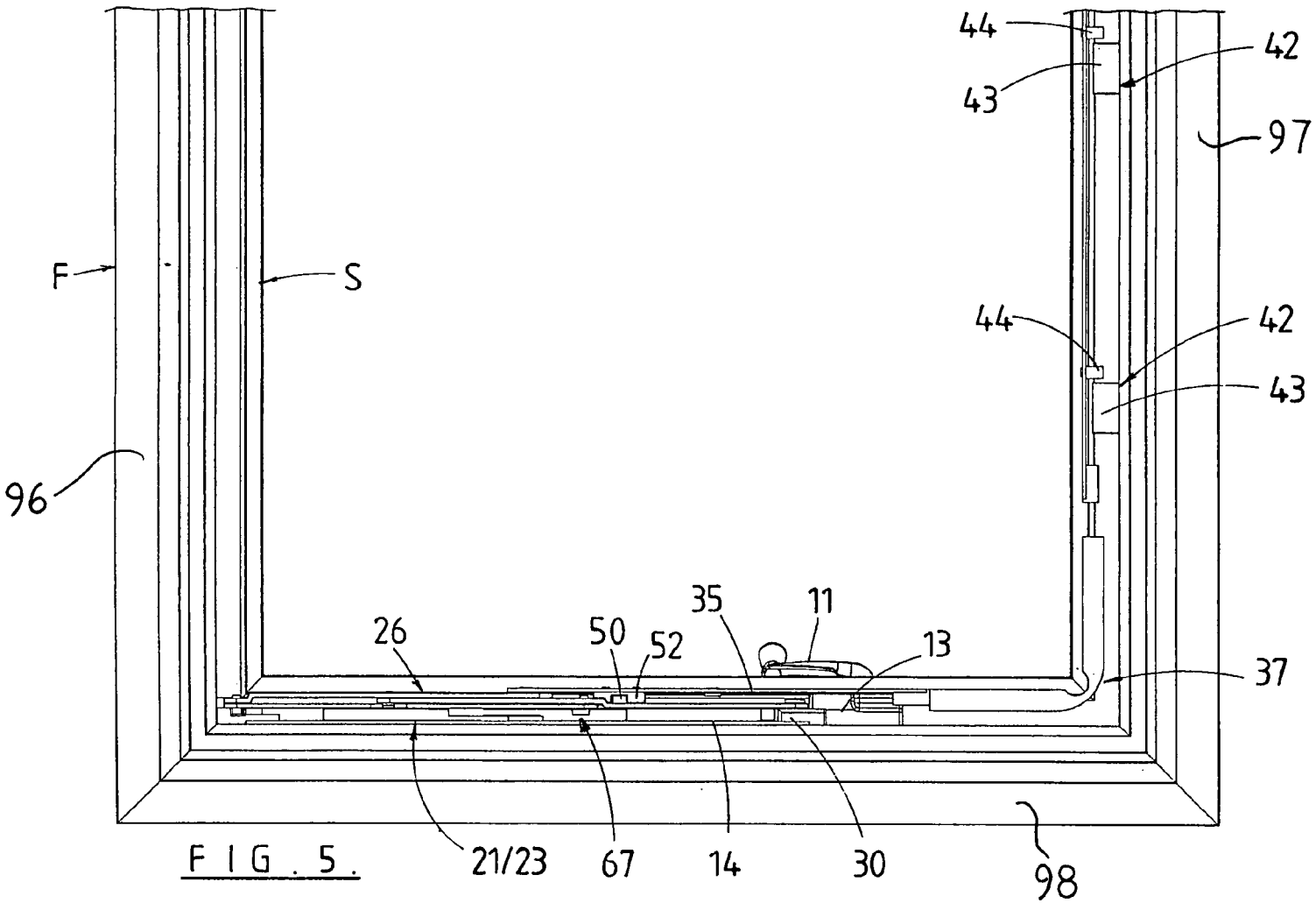
FIG. 5 is an elevation view of the window surround and operator with the multi-point lock.

FIG. 5 shows only two keepers. More or less keepers 42 and lock pins 44 may be incorporated as necessary.

This movement of lock plate 36 is imparted by sliding movement of lock plate 35 which will now be described.

A land 45 (part of the follower 21) is connected with driver 67 via a pin 46. This pin is mounted so that it can move transverse to the direction in which the driver 67 is able to move along the mounting plate 14. An end of the pin 46 locates in a shaped slot 47 in the mounting plate 14. A portion of the pin 46 which extends up from land 45 engages in an L-shaped slot 48 in the driver 67.

Pin 46 will normally sit within a short portion 49 of the L-shaped slot 48. Consequently as the nut 66 moves along the lead screw 16 the movement of the driver 67 (which is coupled to the nut 66) is imparted to the follower 21 by the pin 46. During this movement the slot 47 extends substantially longitudinally along the mounting plate 14, thereby ensuring that the pin 46 remains within portion 49 of the L-shaped slot 48.

However, as the sash approaches its closed position, the slot 47 inclines toward the edge of the mounting plate 14 opposite that at which the housing 18 is located. This causes pin 46 to progressively slide transversely so that it ultimately takes up a position whereby it is aligned with the long portion of L-shaped slot 48. Consequently as the nut 66 continues to move along the lead screw 16, the coupling between the driver 67 and the follower 21 ceases. As a result, the driver 67 moves independent of the follower 21. This corresponds with relative movement between the driver 67 and pin 46 so that ultimately pin 46 locates at the end of the long portion of L-shaped slot 48.

As the sash S approaches its fully closed position, a tab 50 fixed with driver 67 engages in a cut-out 51 in the downwardly projecting coupler 52. The coupler 52 mounted by rivets 53 or the like to the underside of lock plate 35. Consequently, continued movement of driver 67 applies via the inter-engagement of tab 50 in coupler 52, a longitudinal sliding movement to plate 35. This movement is transferred via corner drive 37 to lock plate 36 so that the pins 44 locate behind flanges 43 of keepers 42, as hereinbefore described. Locking of the non hinge-side of the sash in the frame in a multi-point locking arrangement is thereby achieved.

Figure 6:
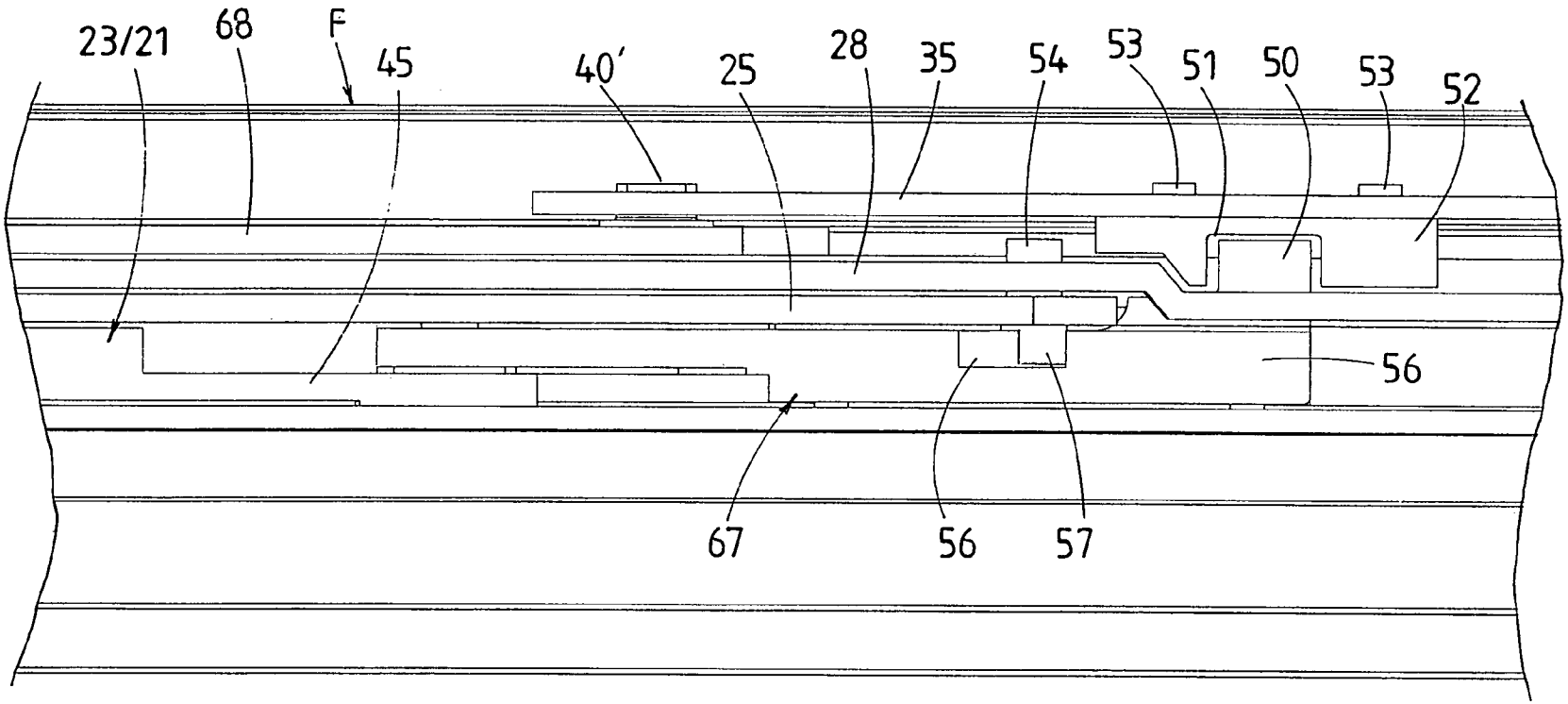
FIG. 6 is a detail view taken from FIG. 5.

Pivot 54 which joins arm 25 to the long arm 28 has a downwardly projecting portion 57 (see FIG. 6) which engages in a shaped slot 55 in the driver 67. As the sash S approaches a closed position the projecting portion 57 enters the forward facing open end of the angled portion of slot 55. The projecting portion 57 thus ultimately becomes located behind upstand 56, which forms part of the slot 55. Therefore, the window stay 26 is locked in the closed position by the engagement of the projecting portion 57 behind the upstand 56.

As a consequence of the above described arrangement, the handle 11 can be rotated beyond the point where the operator 10 has, via stay 26, moved the sash S to a fully closed position within frame F. This rotation results in multi-point locking of the sash to automatically occur. This is due to the engagement of pins 44 with keepers 42 and the projecting portion 57 behind upstand 56. The hinge side of the sash S is further locked in position by the headlock 33 cooperating with the stay 26 in a conventional manner.

Upon the handle 11 being wound to open the window sash S, the first action which takes place is movement of the driver 67 relative to the follower 21L which in the reverse of the previously mentioned operation, aligns the tab 50 with cut out 51 in coupler 52 and positions the projecting portion 57 of pivot bearing 54 in slot 55 so that it is clear of upstand 56. Therefore, the first action upon operation of the operator is an unlocking action.

Continued movement of the driver 19 results in pin 46 engaging with the end wall of the long portion of L-shaped slot 48. This thereby effects a driving coupling with the follower 21 so that the follower 21 commences movement and operates the window stay 26 in a normal manner so as to cause the sash S to open.

Corner drive devices to achieve the function of the corner drive 37 are known. Such devices are used for transmitting motion around a corner (from horizontal to vertical plane, or vice versa) of a window frame or sash to move, for example, lock bars. Movement of one of the connectors to which a lock bar is connected is transmitted by a captivated strap which extends to another connector which in turn is connected to a lock or drive bar.

Most of these corner drive devices use a single piece housing (usually zinc). This necessitates fixing the strap to one or both connectors once the connectors and strap have been assembled into the housing. A different approach, however, is taken in the corner drive device which is preferably used in the present invention.

Figure 7:
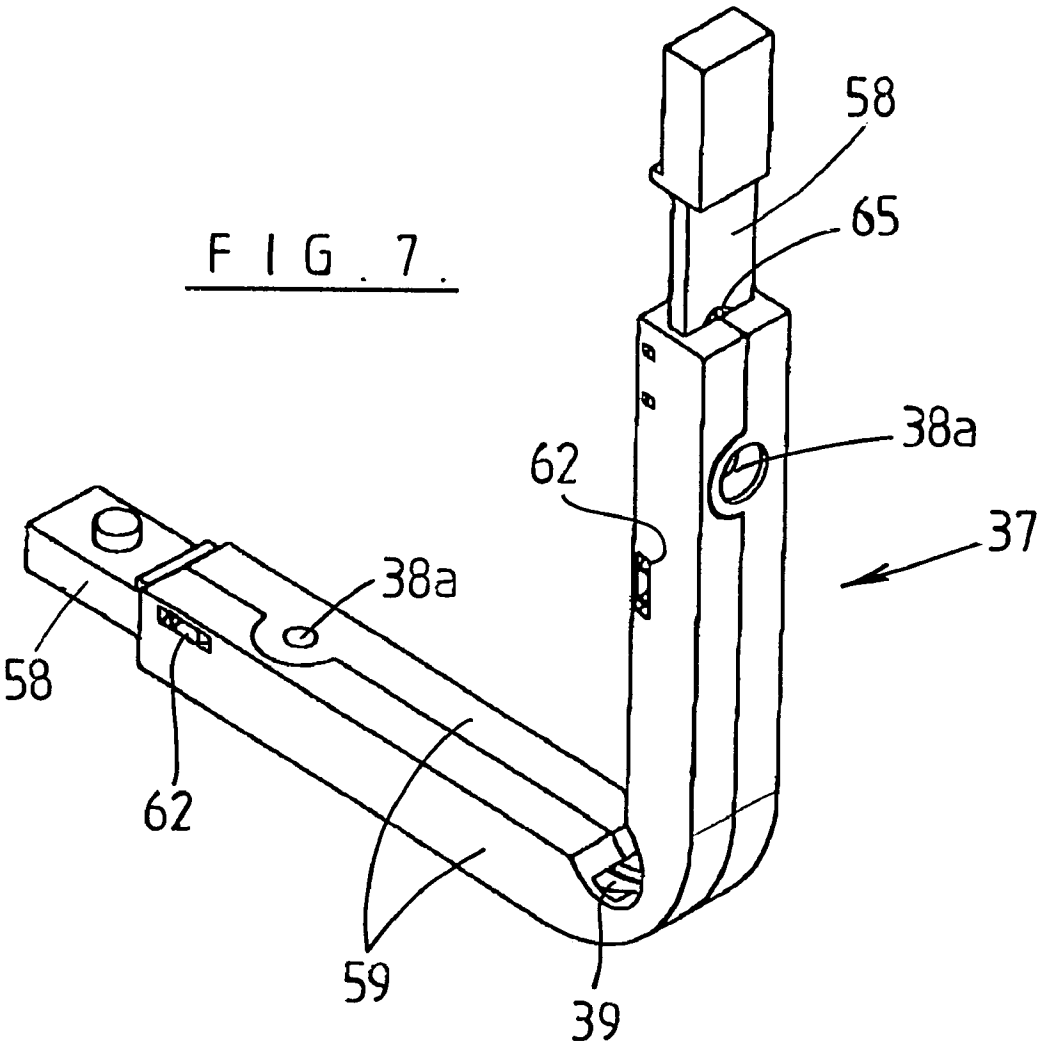
FIG. 7 is a perspective view of the corner drive device.

FIG. 7 of the drawings shows the corner drive 37 and strap 39. Each end of the strap 39 is riveted (or fixed by other means) to a connector 58.

The housing 38 is comprised of two identical parts 59. These are constructed and arranged so that they can be snapped together by clips. The strap 39 is placed in one of the housing parts 59. The second housing part 59 is then snapped onto the first part to complete the unit.

Figure 8:
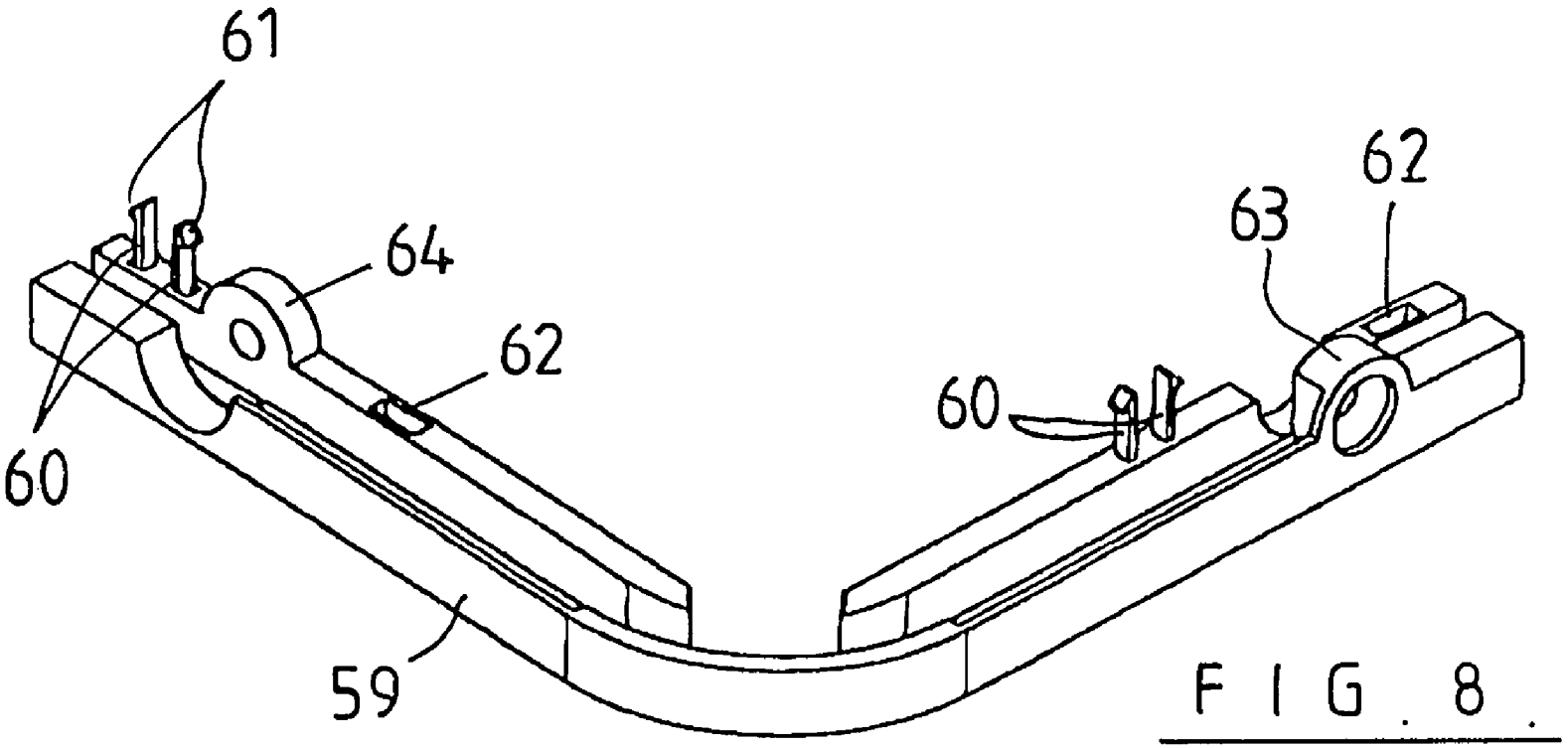
FIG. 8 is a perspective view of one of the two identical housing components of the corner drive device.

FIG. 8 provides a perspective illustration of one of the housing components 59. This illustrates that adjacent each housing opening 38*a* are a pair of legs 60 each having oppositely and outwardly disposed ramp portions 61. To the other side of each opening 38*a* is a slot 62. Accordingly, when two of the housing components 59 are brought together, the respective legs 60 engage into the opposing slot 62 in a snap-lock arrangement. This thereby couples the housing components 59 together.

During installation of the corner drive 37, the housing components 59 are additionally secured together by the fixing screws which extend through openings 38*a* to mount the corner drive device to the window sash or frame. The fixing screws pass through the front screw boss 63, one of the housing components 59 and the back screw boss 64 of the other component. The two bosses 63 and 64 combine to define the aforementioned opening 38*a*.

Figure 9:
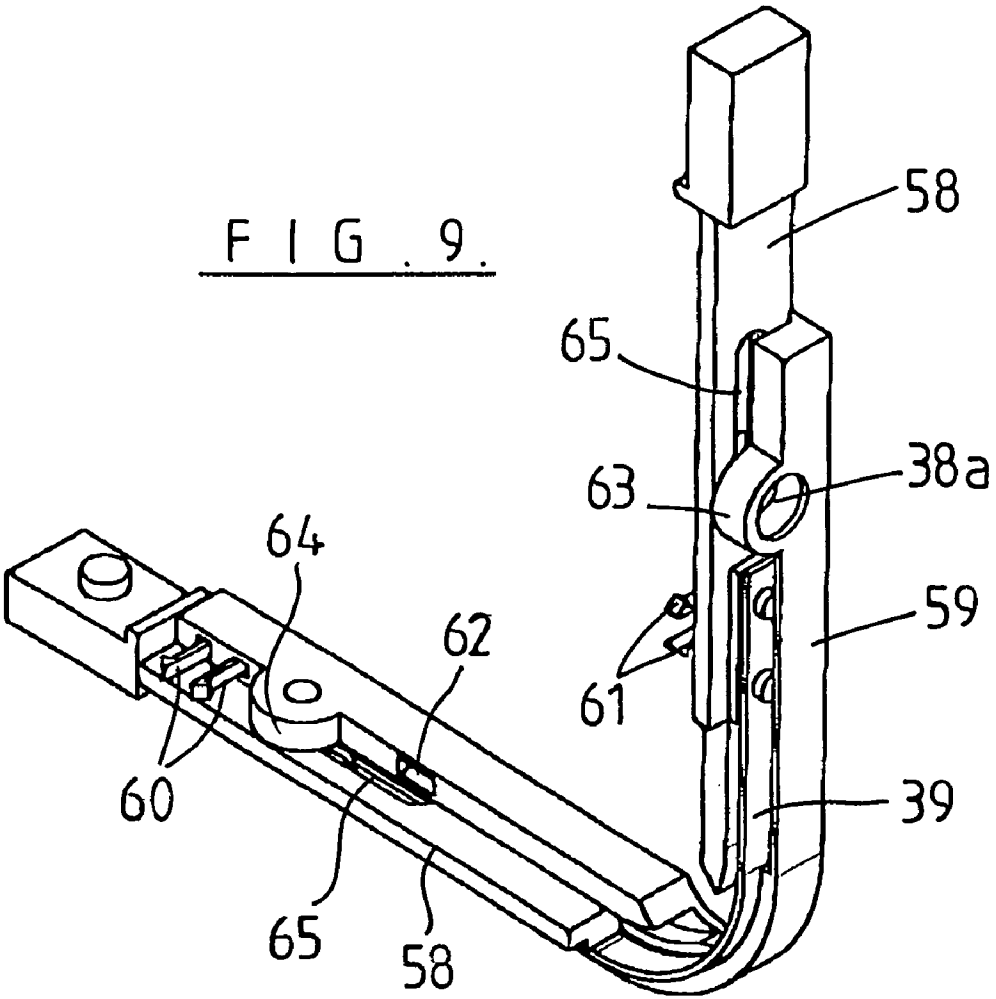
FIG. 9 is a perspective view similar to FIG. 7 but with one of the housing components removed.

As shown in FIG. 9, a screw slot 65 is formed in the connector 58 to allow the fixing screws to pass through the connector without inhibiting the connector from its sliding movement.

Essentially, therefore, the drive unit comprises two identical snap-together housing components which enable the connectors 58 and strap 39 to be assembled together, prior to fitting to the housing.

Figure 10:
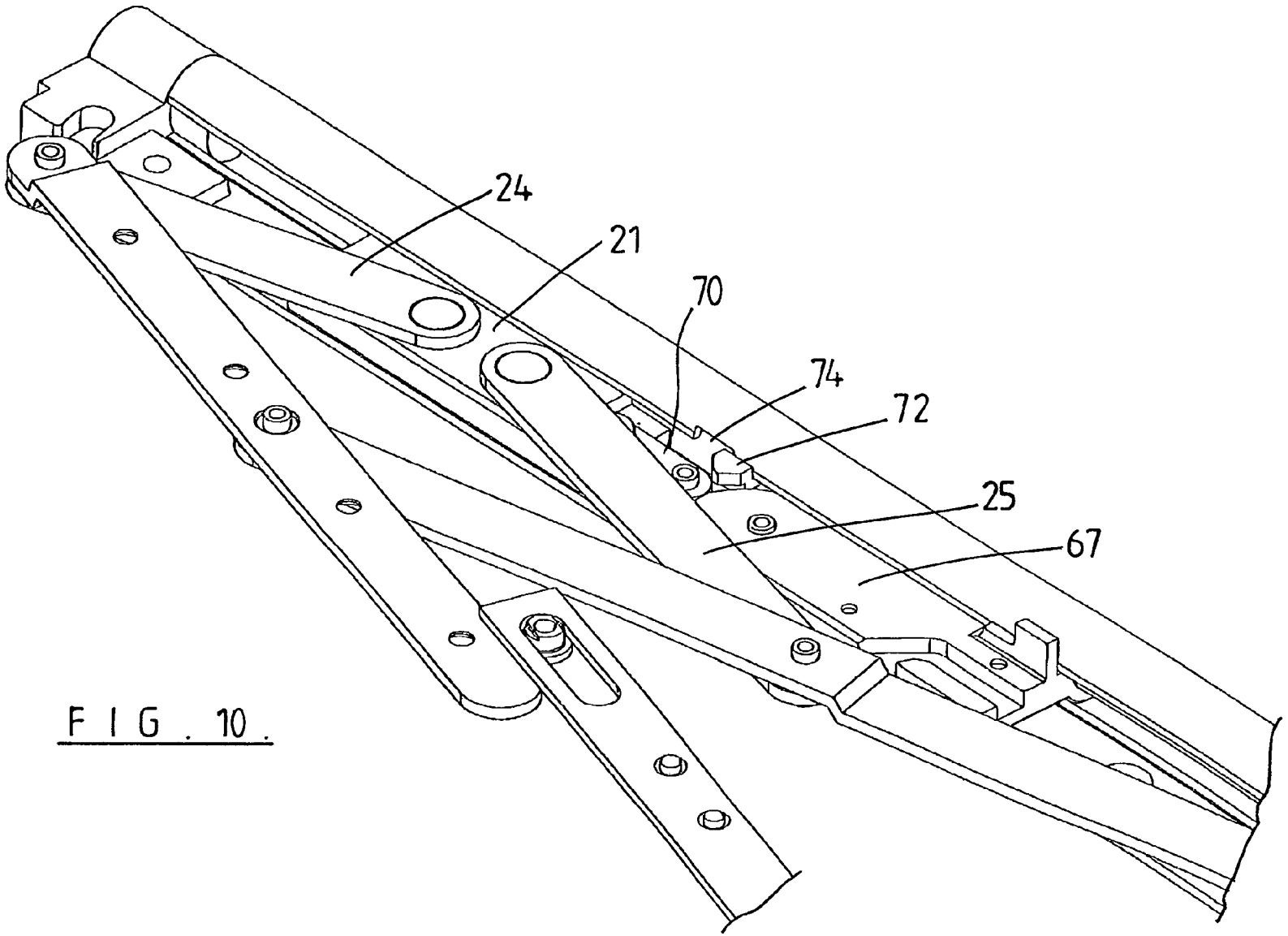
FIG. 10 is a view similar to FIG. 4 but of an alternative form of the invention.
Figure 11:
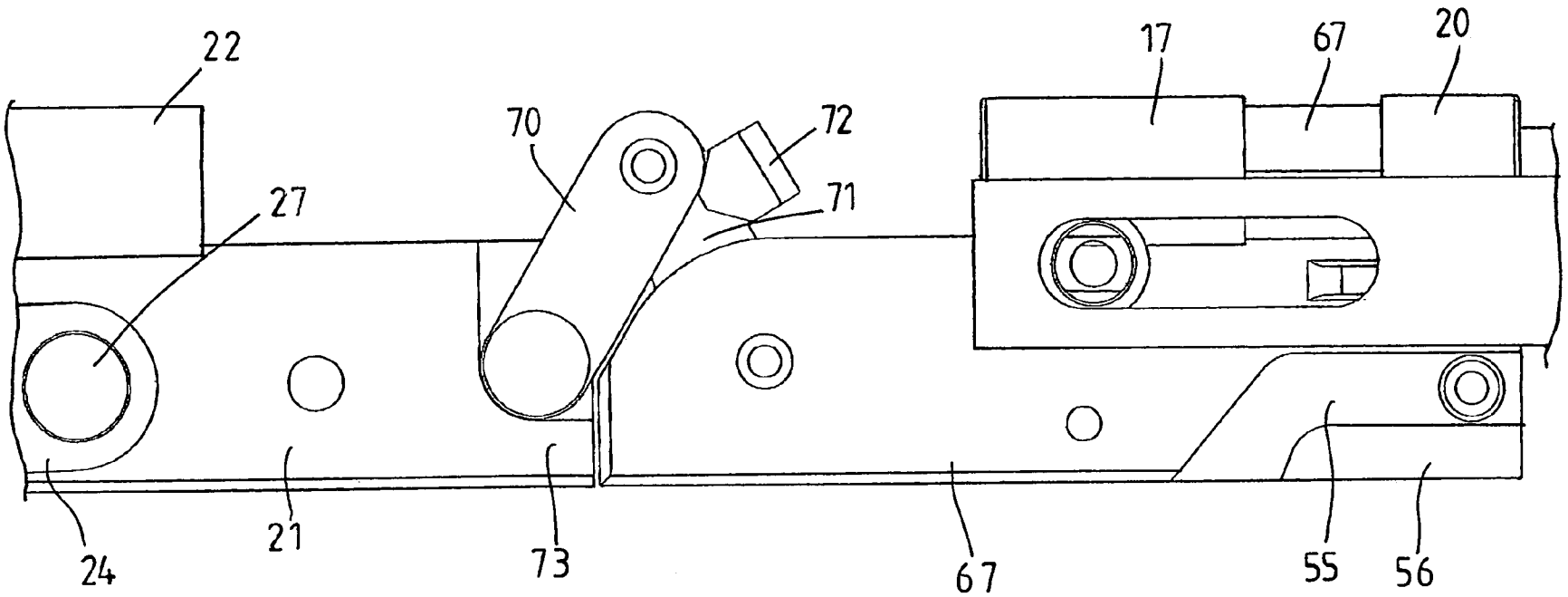
FIG. 11 is a plan part view of the alternative arrangement shown in FIG. 10.

Referring to FIGS. 10 and 11, there is shown an alternative arrangement whereby there is "lost motion" coupling between the driver 67 and the follower 21. This mechanism is effectively formed by a toggle device comprising a first toggle arm 70 pivotally coupled at one end to the follower 21. The other toggle arm 71 is pivotally coupled to the driver 67. The free end of the toggle arm 71 has an upstand 72. In the vicinity of the pivot coupling of the first toggle arm 70, to the follower 21, there is a shoulder 73.

Usually, as shown in FIG. 10, the toggle arms 70 and 71 are aligned or straight. The arms 70 and 71 are prevented from toggling one way by the shoulder 73 on the follower 21, and the other way by the upstand 72 on the toggle arm 71 resting on the elongate housing 18.

When the window sash is almost closed the control arm 25 of the stay hits the upstand 72 and induces toggling to occur. This occurs when the upstand 72 is opposite a notch 74 in the housing 18. The free ends of the toggle arms 70 and 71 are, thus, able to pivot into the cavity of the housing 18. As a result, the driver 67 can move independently of the follower 21 and thereby carry out the locking action as described previously.

Upon opening of the window sash the toggle arms 70 and 71 are pulled straight by the driver 67 moving during the unlocking operation. Upon the arms moving into the aligned or straight position, the coupling effect between the driver 67 and follower 21 is complete. As a result, the follower 21 moves in response to movement of the driver 67.

Figure 12:
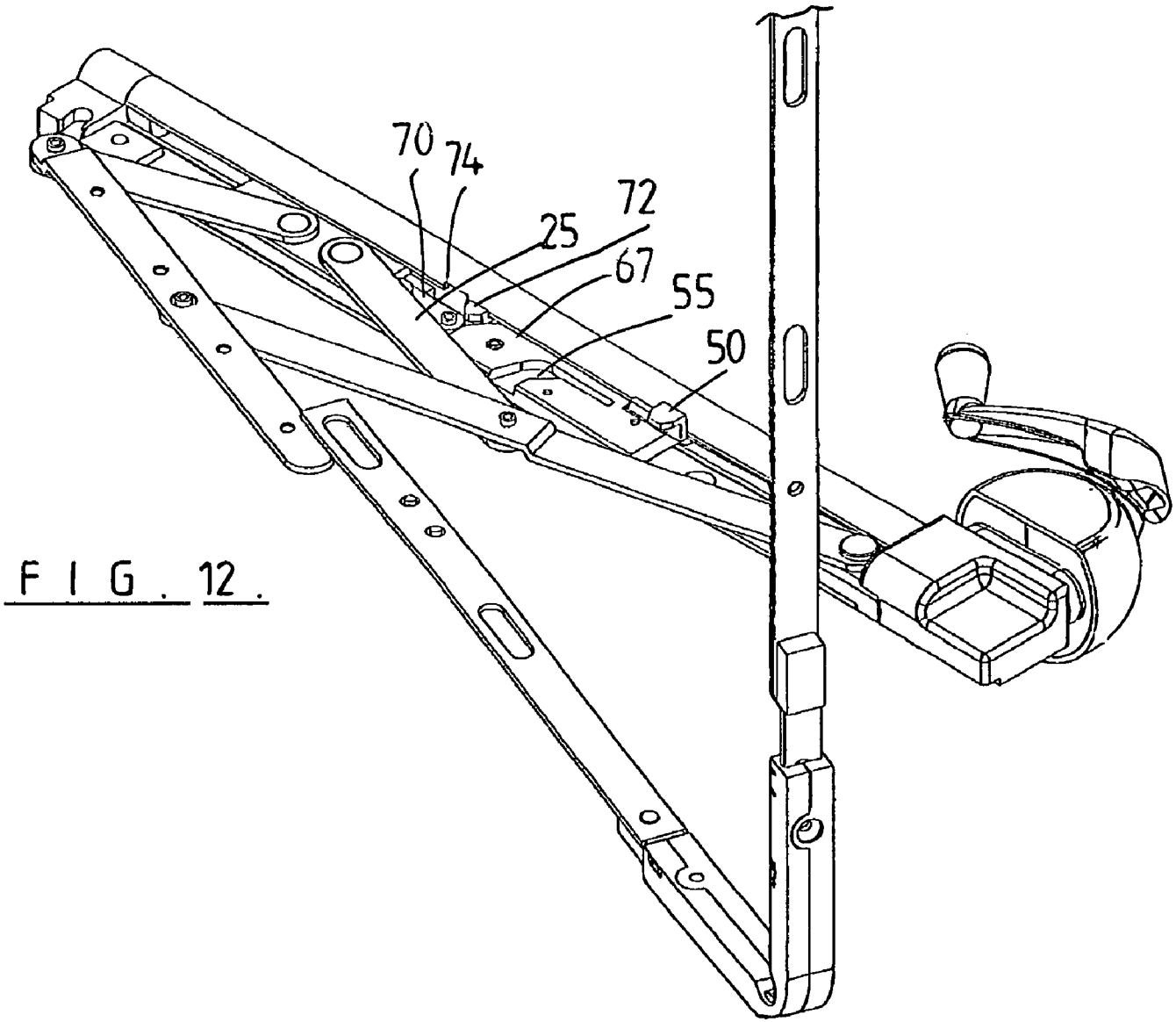
FIG. 12 is yet a further view similar to FIG. 4 but showing a further alternative arrangement.

When the toggling of the toggle arms 70 and 71 occurs at the sash moving to its closed position, the pin 54 is captured by the slot 55, as described previously. However, in an alternative arrangement, as shown in FIG. 12, the slot 55 can be repositioned on the driver 67 and engageable therein is a pin (not shown) which is mounted with the control arm 25 rather than at the pivot join of the control arm and the long arm 28.

The present invention thus provides an operator which incorporates a window stay thereby obviating the need for one of the window stays for mounting of the sash and the frame. The operator can also include the means for operating a multi-point. Also the operator is of a construction whereby it can be concealed within the frame F so that only the handle and the mounting part for the handle is readily visible when the window is closed. This enhances the aesthetic appeal of the window.

What is claimed is:

1. A window operator for controlling the opening and closing movement of a window sash relative to a window frame, the window operator comprising a mounting arrangement for coupling to a sill of said window frame, an elongate threaded member mounted with the mounting arrangement, a first side jam, a second side jam and a top piece, a drive mechanism to apply a rotational movement to the elongate threaded member, a threaded element located on the elongate threaded member, a hinge by which the window sash is hingedly mountable to the window frame, said hinge being connected to the mounting arrangement whereby the hinge is mountable to said element of the window frame, the window operator further comprising a coupling device connected to and moveable in response to movement of the threaded element on the elongate threaded member, the coupling device being further connected to a part of the hinge wherein movement of the coupling device applies a moving force to said part of the hinge.

2. A window operator as claimed in claim 1, further comprising a lost motion mechanism between the threaded element and the coupling, and an engagement device for, in use, engaging with a locking arrangement mountable with a the window sash, the engagement device being movable by said lost motion mechanism to apply a locking action to the locking arrangement.

3. A window operator as claimed in claim 1 wherein the coupling device includes a driver element and a follower element, the follower element having a mounting with which at least one arm of the hinge is pivotally attached.

4. A window operator as claimed in claim 3 wherein the threaded member is housed within an elongate housing the driver element being located externally of the elongate housing and coupled to the threaded element within the elongate housing, the follower being coupled to a sliding element slidingly engaged within the elongate housing.

5. A window operator as claimed in claim 4 wherein the elongate housing is attached to the mounting arrangement.

6. A window operator as claimed in claim 4 further including an end stop with which the sliding element is engageable.

7. A window operator as claimed in claim 6 wherein the end stop includes a head lock with which a part of the hinge is engageable.

8. A window operator for controlling the movement of a window sash between open and closed positions relative to a window frame, the window operator comprising a mounting arrangement for coupling to a sill of said window frame, an elongate threaded member mounted with the mounting arrangement, a first side jam, a second side jam and a top piece, a drive transfer mountable in a cavity formed between the window sash and window frame when the window sash is in a closed position such that the mounting arrangement and drive transfer are not visible when the window sash is in the closed position, an operator handle and handle mounting mountable to a surface of the window frame, the operator handle being coupled to the drive transfer and the drive transfer being drivingly coupled to an elongate threaded member mounted with the mounting arrangement, a threaded element located on the elongate threaded member and a hinge connected to the mounting arrangement—whereby the hinge is mountable to said window frame, the hinge arrangement comprising a sash mounting and at least one arm pivotally coupled at respective ends to the sash mounting and the mounting arrangement, a sliding element associated with the mounting arrangement and coupled to the sash mounting, the sliding element being coupled to the threaded element wherein movement of the threaded element applies a moving force to the hinge to, in use, cause the window sash mounted to the sash mounting to move between said open and closed positions.

9. A window operator in combination with a multi-point lock mechanism, the lock mechanism including a first lock element having an engagement member, the window operator including a mounting arrangement, an elongate threaded member mounted with the mounting arrangement, a drive mechanism to apply a rotational movement to the elongate threaded member, a threaded element located on the elongate threaded member, a hinge with which a window sash can be mounted, a coupling device moveable in response to movement of the threaded element on the elongate threaded member, said coupling device having a driver which upon engagement with the engagement member imparts movement to the first lock element, a lost motion mechanism between the threaded element and the coupling, said engagement member being movable by said lost motion mechanism, and part of the hinge being connected to the coupling such that movement of the coupling results in movement of the hinge.

10. The combination of claim 9 further including a second lock element coupled to the first lock element by a corner drive.

11. The combination of claim 10 further including at least one keeper mountable with a part of a window construction, the second lock element including a first projection which when the second lock element is moved to a locking position interengages with a second projection of the keeper.

12. The combination of claim 10 wherein the corner drive includes a housing formed from first and second housing sections and a flexible elongate element slidingly captured between the first and second housing sections.

13. The combination of claim 12 wherein the first and second housing sections are snap-locked together by clip devices.

14. The combination of claim 13 wherein the first and second housing sections further include apertures which are aligned upon the first and second housing sections being combined, the aligned openings being such as to receive a mechanical fastener to mount the corner and further fix the first and second housing sections together.

15. The combination of claim 14 wherein a connector is fixed to each end of the flexible elongate element, each connector including an elongate opening through which a said mechanical fastener can project.

16. The combination of claim 9 wherein the lost motion coupling is formed by a toggle mechanism and a trigger element mountable with a part of a window construction to induce toggling of the toggle mechanism.

* * * * *

UNITED STATES PATENT AND TRADEMARK OFFICE

CERTIFICATE OF CORRECTION

PATENT NO. : 7,013,604 B1
APPLICATION NO. : 09/610229
DATED : March 21, 2006
INVENTOR(S) : Moody et al.

It is certified that error appears in the above-identified patent and that said Letters Patent is hereby corrected as shown below:

Col. 6, Line 67 after "mountable with" please delete "a".

Signed and Sealed this

Eighteenth Day of September, 2007

JON W. DUDAS
*Director of the United States Patent and Trademark Office*